United States Patent [19]

Shibuya et al.

[11] 3,994,704

[45] Nov. 30, 1976

[54] ELECTRIC DUST COLLECTING APPARATUS

[76] Inventors: Akira Shibuya, 5-22-4, Nukui-Kitamachi, Koganei, Tokyo; Yoshifumi Nitta, 4743-3-208, Sasage, Konan, Yokohama, Kanagawa, both of Japan

[22] Filed: Apr. 7, 1975

[21] Appl. No.: 565,821

[30] Foreign Application Priority Data

Apr. 25, 1974 Japan ..... 49-47325

[52] U.S. Cl. ..... 55/130; 55/138; 55/154; 55/137

[51] Int. Cl.[2] ..... B03C 3/45

[58] Field of Search ..... 55/136, 137, 138, 129, 55/130, 152, 154, 156, 150, 108, 151, 153, 157, 123

[56] References Cited

UNITED STATES PATENTS

| | | | |
|---|---|---|---|
| 1,333,790 | 3/1920 | Bradley | 55/152 X |
| 2,016,531 | 10/1935 | Wintermute | 55/136 X |
| 2,383,030 | 8/1945 | White | 55/154 X |
| 2,532,734 | 12/1950 | Schmidt | 55/154 X |
| 3,518,813 | 7/1970 | Werner | 55/152 X |
| 3,803,808 | 4/1974 | Shibuya et al. | 55/129 X |

*Primary Examiner*—Frank W. Lutter
*Assistant Examiner*—David L. Lacey
*Attorney, Agent, or Firm*—Price, Heneveld, Huizenga & Cooper

[57] ABSTRACT

An improved dust collecting apparatus is described, in a first section of which are disposed a plurality of linear discharge electrodes and a plurality of planar dust collecting electrodes in an opposed relationship to each other within a casing that has an inlet port for introducing a dust-containing gas formed at one end and that has an outlet port for discharging a dust-free gas formed at the other end, so that the dust in the dust-containing gas may be charged and also collected in said first section. Downstream of said first section of the apparatus are aligned a plurality of rod-shaped driver electrodes spaced apart from each other along a plane transverse of a gas flow, and on the side surfaces of said driver electrodes are provided lengthwise channels having their openings directed to the outlet port side. Downstream of the gas spaces formed between adjacent ones of said driver electrodes are disposed a plurality of rod-shaped collector electrodes, and on the side surfaces of said collector electrodes are provided lengthwise channels having their openings directed to the inlet port side. A negative terminal of a D.C. power source is connected to said driver electrodes, while a positive terminal of a D.C. power source is connected to said collector electrodes, whereby the dust that has been charged in the space between said discharge electrodes and said dust collecting electrodes but has not adhered to the dust collecting electrodes and that has been respattered can be collected within the lengthwise channels of said collector electrodes.

3 Claims, 5 Drawing Figures

ELECTRIC DUST COLLECTING APPARATUS

Figure 1:
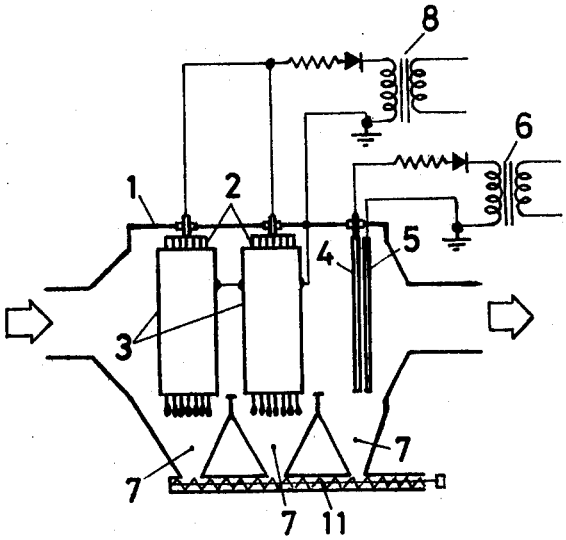

The present invention relates to an electric dust collecting apparatus which makes it possible to efficiently collect a dust contained in an exhaust gas from a cement baking installation, a heavy oil combustion boiler, etc.

In general, an electric dust collecting apparatus is equipped downstream of an exhaust gas source such as combustion installations, cement baking installations, etc. and is often used as means for removing a dust contained in an exhaust gas.

Recently, in an area where a great many exhaust gas sources exist, such as an industrial area, degradation of an environmental sanitation caused by a falling dust has become marked, and accordingly, there arises a necessity of enhancing the dust collecting apparatuses either by reconstructing them or by replacing new apparatuses therefor.

In the prior art for improving a performance of an electric dust collecting apparatus, an apparatus is known in which downstream of a dust collecting chamber, are arranged a plurality of C-shaped additional dust collecting plates having surfaces for intercepting a gas flow, in a zig-zag manner transversely of the gas flow.

However, apparatuses having such a structure were constructed for the purpose of achieving a simple dust intercept effect and a passive effect of electrically adhering a dust, so that they could not always effectively collect the dust that accompanies an exhaust gas due to respattering, and the lowering of efficiency due to respattering that is produced upon hammering operation and the like could not be obviated yet.

An object of the present invention is to provide an electric dust collecting apparatus that has a more improved dust collecting efficiency than the conventional dust collecting apparatuses.

Another object of the present invention is to provide an electric dust collecting apparatus in which respattering of a dust into a gas flow may not occur when a dust adhered to a dust collecting apparatus is caused to fall by hammering.

Still another object of the present invention is to provide an electric dust collecting apparatus having a high dust collecting efficiency without the posibility of respattering of a dust caused by hammering, which is adapted to be easily reconstructed from the conventional type of electric dust collecting apparatus including linear discharge electrodes and planar dust collecting electrodes.

According to one feature of the present invention, there is provided an electric dust collecting apparatus comprising a dust collecting chamber including a plurality of linear discharge electrodes and a plurality of planar dust collecting electrodes disposed therein in an opposed relationship to each other for charging and collecting a dust contained in an exhaust gas within the same space, characterized in that downstream of said dust collecting chamber are disposed a group of channel shaped driver electrodes and a group of channel shaped collector electrodes, each said electrode including electric field forming surfaces having such curvature that a corona discharge may be prevented thereby, and in that said apparatus comprises a power source for applying a high voltage between said group of driver electrodes and said group of collector electrodes.

Figure 3:
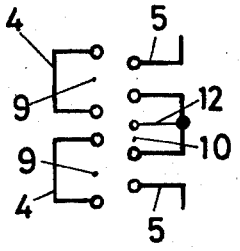
Figure 4:
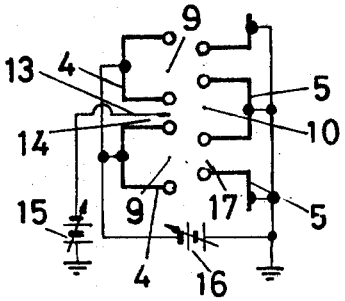
Figure 2:
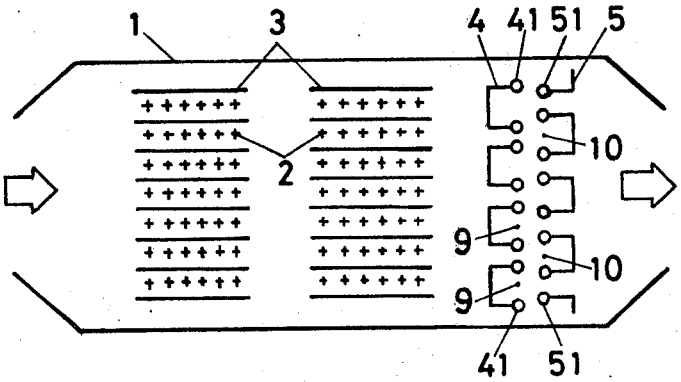
Figure 5:
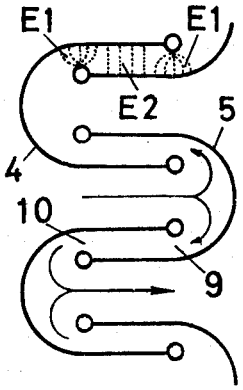

These and other features and objects of the present invention will become more apparent by reference to the following description taken in conjunction with the accompanying drawings, in which:

FIGS. 1 and 2 show one preferred embodiment of the electric dust collecting apparatus according to the present invention, FIG. 1 being a vertical cross-section view of the entire electric dust collecting apparatus, while FIG. 2 being a horizontal cross-section view of the same apparatus, and FIGS. 3, 4 and 5, respectively, are partial horizontal cross-section views showing other modified embodiments of one part of the apparatus shown in FIGS. 1 and 2.

Referring now to FIGS. 1 and 2, reference numeral 1 designates a casing, numeral 2 designates discharge electrodes consisting of a plurality of barbed wires suspended from the casing along a gas flow and insulated from said casing, numeral 3 designates a plurality of planar dust collecting electrodes disposed on the opposite sides of the respective rows of said discharge electrodes 2, numeral 7 designates hoppers for storing the dust collected by this apparatus, a dust collecting chamber is composed of one set of discharge electrodes 2, dust collecting electrodes 3 and a hopper 7, and there are provided two said dust collecting chambers. Reference numerals 4 and 5 designate channel-shaped driver electrodes and channel-shaped collector electrodes, respectively, disposed downstream of the final dust collecting chamber, each of said electrodes including electric field forming surfaces 41 or 51 having such curvature that a corona discharge may be prevented, and an appropriate number of said driver electrodes 4 and an appropriate number of said collector electrodes are aligned transversely of the gas flow to form a driver electrode group and a collector electrode group, respectively. The respective driver electrodes 4 are disposed with their opening 9 directed towards a gas outlet port of the casing 1, while the respective collector electrodes 5 are disposed with their opening 10 directed towards a gas inlet port of the casing 1.

Reference numeral 8 designates a power source connected to the discharge electrodes 2 and the dust collecting electrodes 3 for supplying a voltage of 30 KV to 35 KV, numeral 6 designates another power source for supplying a voltage of 40 KV, said driver electrodes 4 being connected to a negative high voltage terminal of said power supply 6, and said collector electrodes 5 are connected to a positive grounded terminal of the power supply 6. Numeral 11 designates a screw conveyor for exhausting the collected dust out of the hoppers 7.

A dust generated in a heavy oil combustion boiler, a cement baking system and the like (not shown) would accompany the exhaust gas, and while the dust-containing gas is passing through the dust collecting chamber provided on the inlet port side of the electric dust collecting apparatus, the dust would be charged by the discharge electrodes 2 and the dust collecting electrodes 3, and simultaneously would be collected by the latter electrodes. The dust which could not be collected by the first dust collecting chamber, enters the next subsequent dust collecting chamber, and it is charged and collected in a similar manner to the above.

Since the dust adhered onto the dust collecting electrodes 3 successively piles and grows, the electrodes 3 are periodically hammered with a hammering device, not shown, to cause the dust adhered onto the dust collecting electrodes 3 to fall into the hoppers 7, when an appropriate amount of dust has adhered onto said electrodes 3, and then the dust is exhausted to the exterior by means of the screw conveyor 11.

On the other hand, the dust respattered upon hammering operation consists of charged particles which have been aggregated and have become coarse to a certain extent, and the charged particles flow in association with the exhaust gas to the rear part of the dust collecting chamber. The charged particles are accelerated while they pass by the driver electrodes 4, owing to the cooperative effects of the electric field which tends to guide the charged particles formed between the driver electrodes into the openings of the electrodes in the rear stage, and the gas flow which tends to hydrodynamically converging the charged particles and thereby to guide the particles into the interior of the pockets while holding the charged particles within an effective region of the electric field; and the charged particles are transferred to the openings 10 of the collector electrodes 5 as electrically restrained, adhere onto the surfaces of the collector electrodes 5, and thus they are collected by the collector electrodes 5. The flow of the exhaust gas is reversed at a portion of each collector electrode 5, and is exhausted to the exterior under a dust-free state. When an appropriate amount of dust has adhered onto the collector electrodes 5, the dust is caused to fall into the hopper 7 by hammering the collector electrodes similarly to the above-described operation, and then it is exhausted to the exterior by means of the screw conveyor 11.

While the above-described embodiment of the invention has been explained with respect to the case where the driver electrode group and the collector electrode group are disposed downstream of the final dust collecting chamber, the present invention should not be limited to such an arrangement, but instead the invention can be equally practiced by disposing a driver electrode group and a collector electrode group just behind each said dust collecting chamber, and in such a modification it is possible to construct a small size of apparatus and also to reduce the floor area for installation.

In addition, if a central electrode 12 having the same polarity as the collector electrode 5 is disposed along a center plane of said collector electrode 5 as shown in FIG. 3, then the effect of collecting a dust at the center portion of the opening can be expected, and thereby the dust collecting efficiency can be further improved.

FIG. 4 shows another modification of the embodiment illustrated in FIG. 1, which employs discharge electrodes 13 for preventing the dust particles from respattering. In this modified embodiment, along center planes of the gap 14 spaces formed between adjacent rod-shaped driver electrodes 4 are disposed auxiliary discharge electrodes 13 having an opposite polarity to the driver electrodes 4, said auxiliary discharge electrodes 13 are connected to a D.C. high voltage power source 15 whose supply voltage value is variable so that a D.C. high voltage having a variable value may be applied between said auxiliary discharge electrodes 13 and the rod-shaped collector electrodes 5, and the rod-shaped driver and collector electrodes are connected to a D.C. high voltage source 16 whose supply voltage value is variable so that a D.C. high voltage having a variable value may be applied between said respective rod-shaped electrodes. In FIG. 4, reference numeral 17 designates gap spaces between adjacent collector electrodes 5.

In the thus constructed apparatus, the dust which has been once adhered onto and collected by the electrode surfaces within the openings 10 of the rod-shaped collector electrodes 5 is electrically confined by the action of an ion current established at an optimum value by means of the two D.C. high voltage power source 15 and 16 having variable supply voltages, and also the interior of the openings 10 of the collector electrodes 5 becomes a region protected by a gas flow. Therefore, in any case, the dust would not respatter from an accumulated dust layer, but would be peeled off from the surface of the electrodes due to the vibration applied to the rod-shaped collector electrodes 5 by means of a hammering device, and would fall vertically into the interior of the hopper 7 under the state where the dust is held within the openings 10 owing to the action of the protective region and the ion current, whereby the dust can be completely separated from the gas flow and collected. Therefore, it is possible to almost eliminate the respattering of a dust and to greatly improve the dust collecting efficiency.

FIG. 5 shows a still another embodiment of the embodiment illustrated in FIG. 1, in which the arrangements of the both rod-shaped electrodes 4 and 5 are different from those of the above-described embodiments. In this modified embodiment, the rod-shaped driver and collector electrodes 4 and 5 have a V-shaped transverse cross-section, and these rod-shaped electrodes are disposed close to each other in such positions that the gap spaces formed between the adjacent rod-shaped driver electrodes 4 may be accomodated within the openings 10 of the respective rod-shaped collector electrodes 5. Owing to such an electrode arrangement, when a D.C. voltage is applied between the respective electrodes, two different types of electric field regions, that is, an uneven electric field region E1 and an even electric field region E2 are established. In this electrode arrangement, the gas which has passed through the dust collecting chamber, flows through the gap space formed between adjacent rod-shaped driver electrodes 4, and after it has struck against the surface of the rod-shaped collector electrode 5 it is reversed and branched equally to two directions. Each said branched flow is again reversed after is has passed through the aforementioned two different types of electric field regions E1, E2 and E1, and then joins with another branched flow and is led out downstream of said rod-shaped electrodes 4 and 5. During these processes, the charged dust particles respattered from the dust collecting chamber and associated with the gas flow would be electrically collected by the action of said two different types of electric field regions.

Now the effectiveness of the dust collecting apparatus according to the present invention illustrated in FIGS. 1 and 2 will be described hereinunder with respect to two practical examples of operation.

EXAMPLE 1

In an existing electric dust collecting apparatus comprising discharge electrodes and dust collecting electrodes, the above-described driver electrodes and collector electrodes according to the present invention were additionally provided, and a D.C. power source was connected to these electrodes. To an inlet port of such an apparatus was supplied an exhaust gas discharged from a cement baking installation having a dust concentration of $30g/Nm^3$ at a temperature of 150° C and at a flow rate of 10,000 m³/min., where N means the concentration at normal conditions of standard temperature and pressure (i.e., 0° C. and 760 mm atmospheric pressure). Then, the exhaust gas discharged from the outlet port of said dust collecting apparatus had a dust concentration of 0.08 g/Nm³, and thus the dust collecting efficiency was 99.73%.

Whereas, in case that the same exhaust gas was supplied to an inlet port of an existing dust collecting apparatus which is not provided with said driver electrodes and said collector electrodes, the exhaust gas discharged from the outlet port of the apparatus had a dust concentration of 0.2 g/Nm³, and thus the dust collecting efficiency was 99.33%.

EXAMPLE 2

When an exhaust gas discharged from a clinker cooler in a cement baking installation was supplied to an inlet port of an newly constructed electric dust collecting apparatus as shown in FIGS. 1 and 2 under the conditions of, for example, a gas flow rate of 12,000 m³/min, a gas temperature of 250° C, and a dust concentration of 25 g/Nm³, the dust concentration of the exhaust gas discharged from an electric dust collecting machine was 0.05 g/Nm³, and thus the dust collecting efficiency was 99.8%.

In this case, the length of the electric dust collecting apparatus as measured from the inlet port end to the outlet port end was 10,800 mm, the width was 26,000 mm and the height was 18,000 mm. Whereas in the case of the conventional electric dust collecting apparatus for processing an exhaust gas having the same nature and the same flow rate, the length of the apparatus as measured from the inlet port end to the outlet port end was 15,800 mm, the width was 26,000 mm and the height was 18,000 mm.

From the above-described examples, it will be seen that the electric dust collecting apparatus according to the present invention, which has been either newly constructed or reconstructed from the conventional electric dust collecting apparatus, can be greatly improved in a dust collecting efficiency.

In addition, in case that the apparatus according to the present invention is newly constructed, it is possible to reduce the length of the apparatus as measured from the inlet port end to the outlet port end. In other words, according to the present invention there is provided an electric dust collecting apparatus that has a smaller size and a more excellent performance than the conventional electric dust collecting apparatuses.

While the present invention has been described above in connection to one preferred embodiment and its partly modified embodiments, it is intended that the present invention should not be limited to these embodiments, and many changes and modifications thereof could be made within the scope of the invention without departing from the spirit of the invention.

What is claimed is:

1. In an electric dust collecting apparatus including a plurality of linear discharge electrodes and a plurality of planar dust collecting electrodes disposed in an opposed relationship to each other within a casing having a dust-containing gas inlet port at one end and an outlet port at an opposite end and a first D.C. power source coupled between said discharge electrodes and said dust collecting electrodes, and a dust collecting hopper at the bottom of said casing, the improvement comprising:

a plurality of driver electrodes positioned in said casing and spaced from one another to define a gap space therebetween, said driver electrodes disposed within said casing on the outlet port side of said discharge electrodes and said dust collecting electrodes, each said driver electrode comprising a channel positioned with its opening directed towards said outlet port;

a plurality of collector electrodes spaced from one another and disposed within said casing on the outlet port side of said driver electrodes and spaced therefrom, each of said collector electrodes comprising a channel positioned in said casing with its opening facing the gap space provided between adjacent ones of said driver electrodes;

a second D.C. power source coupled between said driver electrodes and said collector electrodes; and an auxiliary electrode positioned between adjacent ones of said driver electrodes and a variable D.C. power source coupled to said auxiliary electrodes for applying a variable D.C. high voltage between said auxiliary electrodes and said collector electrodes, and wherein said D.C. power source coupled between said driver electrodes and said collector electrodes is variable in voltage.

2. In an electric dust collecting apparatus including a plurality of linear discharge electrodes and a plurality of planar dust collecting electrodes disposed in an opposed relationship to each other within a casing having a dust-containing gas inlet port at one end and an outlet port at an opposite end and a first D.C. power source coupled between said discharge electrodes and said dust collecting electrodes, and a dust collecting hopper at the bottom of said casing, the improvement comprising:

a plurality of driver electrodes positioned in said casing and spaced from one another to define a gap space therebetween, said driver electrodes disposed within said casing on the outlet port side of said discharge electrodes and said dust collecting electrodes, each said driver electrode comprising a channel positioned with its opening directed towards said outlet port;

a plurality of collector electrodes spaced from one another and disposed within said casing on the outlet port side of said driver electrodes and spaced therefrom, each of said collector electrodes comprising a channel positioned in said casing with its opening facing the gap space provided between adjacent ones of said driver electrodes;

a second D.C. power source coupled between said driver electrodes and said collector electrodes; and wherein each of said driver electrodes and said collector electrodes has a U-shaped cross section, and the ends of adjacent driver electrodes which bound the gap space between said adjacent driver electrodes are disposed within the U-shaped channels of aligned collector electrodes.

3. An electric dust collecting apparatus comprising:

a casing having an inlet port and an outlet port remote from said inlet port for permitting the flow of contaminated gas through said casing;

a plurality of driver electrodes positioned in said casing and spaced from one another to define a gap space therebetween, each said driver electrode comprising a channel positioned with its opening directed towards said outlet port;

a plurality of collector electrodes spaced from one another and disposed within said casing on the outlet port side of said driver electrodes and spaced therefrom, each of said collector electrodes comprising a channel positioned in said casing with its opening facing the gap space provided between adjacent ones of said driver electrodes;

a D.C. power source coupled between said driver electrodes and said collector electrodes; and wherein each of said driver electrodes and said collector electrodes has a U-shaped cross section with substantially planar leg portions, and the leg portions of adjacent driver electrodes which bound the gap space between said adjacent driver electrodes are disposed within the U-shaped channels of aligned collector electrodes with the planar leg portions overlying and parallel to one another.

* * * * *